US011077355B1

(12) United States Patent
Watts

(10) Patent No.: US 11,077,355 B1
(45) Date of Patent: Aug. 3, 2021

(54) BUMPER APPARATUS FOR A BOARD VEHICLE

(71) Applicant: Titus Gadwin Watts, San Francisco, CA (US)

(72) Inventor: Titus Gadwin Watts, San Francisco, CA (US)

( * ) Notice: Subject to any disclaimer, the term of this patent is extended or adjusted under 35 U.S.C. 154(b) by 0 days.

(21) Appl. No.: 16/572,345

(22) Filed: Sep. 16, 2019

Related U.S. Application Data

(60) Provisional application No. 62/734,143, filed on Sep. 20, 2018.

(51) Int. Cl.
*A63C 17/00* (2006.01)
*A63C 17/01* (2006.01)

(52) U.S. Cl.
CPC ..... *A63C 17/002* (2013.01); *A63C 17/01* (2013.01)

(58) Field of Classification Search
CPC ..... A63C 1/00; A63C 17/01; A63C 17/002; A63C 17/00
USPC ..... 280/11.19, 11.28, 87.04, 608, 610, 770; 293/142
See application file for complete search history.

(56) References Cited

U.S. PATENT DOCUMENTS 4,150,838 A * 4/1979 Lappage ..... A63C 17/01 280/843
4,586,451 A * 5/1986 Mori ..... B63B 59/02 114/219
4,681,333 A * 7/1987 Rouge ..... A63C 17/006 280/11.28
4,719,952 A * 1/1988 Geronimo ..... B63B 32/70 206/315.1
5,067,058 A * 11/1991 Standley ..... A63C 17/26 362/459
5,132,883 A 7/1992 La Lumandier
5,163,550 A * 11/1992 Hawk ..... B63B 32/80 206/315.1
5,664,808 A * 9/1997 Whidden ..... A63C 11/02 150/154
5,738,180 A * 4/1998 Hofmann ..... B62J 25/00 180/291
5,967,314 A * 10/1999 McGovern ..... A63C 11/027 150/154
6,059,307 A * 5/2000 Western ..... A63C 5/124 280/609
6,059,308 A * 5/2000 Baudin ..... A63C 5/048 280/14.21
6,802,636 B1 * 10/2004 Bailey, Jr. ..... A63C 17/01 280/841

(Continued)

*Primary Examiner* — John D Walters
*Assistant Examiner* — Hilary L Johns
(74) *Attorney, Agent, or Firm* — Plager Schack LLP; Mark H. Plager; Michael J. O'Brien

(57) ABSTRACT

A bumper apparatus is coupled to a board vehicle to protect the periphery of the board vehicle from damage and wear. The board vehicle includes a board with a top surface, a bottom surface, a front end, a rear end, and a pair of side ends. The bumper apparatus includes a bent elongated member extending along the periphery of the board vehicle and having a front portion continuously connected to a rear portion by a pair of side portions, and a primary crossbar connecting the pair of side portions of the elongated member together and coupled to the board. The bent elongated member serves as a barrier along the front, rear and side ends of the board vehicle.

6 Claims, 2 Drawing Sheets

(56) References Cited

U.S. PATENT DOCUMENTS

| | | | | |
|---|---|---|---|---|
| D643,493 | S * | 8/2011 | Nickolaisen | D21/771 |
| 8,241,723 | B2 * | 8/2012 | Schneider | A63C 17/017 428/99 |
| 8,333,630 | B1 * | 12/2012 | Bedford | B63B 32/51 441/74 |
| 9,248,367 | B2 | 2/2016 | Imbrie | |
| 9,375,632 | B1 * | 6/2016 | Kish | A63C 17/017 |
| 10,137,357 | B1 * | 11/2018 | Rosolowski | A63C 17/017 |
| 2002/0135998 | A1 * | 9/2002 | Chiu | B62J 6/12 362/103 |
| 2003/0102650 | A1 * | 6/2003 | Gordon | A63C 17/017 280/610 |
| 2003/0160410 | A1 * | 8/2003 | Yang | A63C 17/26 280/87.042 |
| 2003/0201636 | A1 * | 10/2003 | McCoy | A63C 11/027 280/814 |
| 2004/0135347 | A1 * | 7/2004 | Marion | A63C 5/03 280/610 |
| 2005/0139406 | A1 * | 6/2005 | McLeese | A63C 17/04 180/180 |
| 2011/0221179 | A1 * | 9/2011 | Nickolaisen | A63C 17/002 280/809 |
| 2011/0236607 | A1 * | 9/2011 | Woncik | A63C 17/0093 428/12 |
| 2013/0328280 | A1 * | 12/2013 | Meyer | A63C 17/012 280/87.042 |
| 2017/0259160 | A1 * | 9/2017 | Docter | A63C 5/052 |

* cited by examiner

BUMPER APPARATUS FOR A BOARD VEHICLE

RELATED APPLICATION

The application claims priority to provisional patent application U.S. Ser. No. 62/734,143 filed on Sep. 20, 2018, the entire contents of which is herein incorporated by reference.

BACKGROUND

The embodiments herein relate generally to board vehicles. More specifically, embodiments of the invention relate to a bumper apparatus for a board vehicle.

Board vehicles such as skateboards, snowboards and the like, are used for sporting events, recreational activities and/or transportation purposes. Each vehicle comprises a board that serves as a platform to support a user thereon. In the case of skateboards, wheels are connected to the bottom of the board by trucks. During use, the bottom and side edges of these board vehicles frequently contact the ground, packed snow or ice, other vehicles or objects. As such, these board vehicles are subject to premature wear and/or damage resulting in scratches, dents, and the like.

Currently, tape, resin and other similar-type materials are disposed on skateboards, snowboards and other board vehicles as a protective measure. However, these items easily wear and tear and therefore only serve as a temporary solution. Other edge protectors for skateboards exist as disclosed in U.S. Patent Application Publication 2011/0221179, and U.S. Pat. Nos. 9,248,367 and 5,132,883. These protectors comprise various bumpers, nose guards and/or covers that attach to the board vehicle. However, these protectors are limited for one or more of the following reasons: (1) the protector does not extend over the entire periphery of the board, thereby limiting the amount of protection provided; and/or (2) the protector is not sufficiently fastened to the board to handle strong impacts between the board and other objects.

As such, there is a need in the industry for a bumper apparatus for a board vehicle that addresses the limitations of the prior art, which helps to protect the vehicle's entire periphery from damage or wear during use. There is a further need for the bumper apparatus to have enhanced connection strength to the board to handle strong impacts between the board and other objects.

SUMMARY

In certain embodiments of the invention, a bumper apparatus is coupled to a board vehicle and is configured to protect portions along a periphery of the board vehicle from damage and wear. The board vehicle comprises a board with a top surface, a bottom surface, a front end, a rear end, and a pair of side ends. The bumper apparatus comprises a bent elongated member with a pathway extending along the periphery of the board vehicle along the front end, rear end and pair of side ends, the elongated member comprising a front portion continuously connected to a rear portion by a pair of side portions, and a primary crossbar connecting the pair of side portions of the elongated member together and coupled to the board, the primary crossbar extending along the board from the first side end in the pair of side ends to the second side end in the pair of side ends of the board, wherein the bent elongated member is configured to serve as a barrier along the front, rear and side ends of the board vehicle during use.

In one embodiment, the bumper apparatus comprises a secondary crossbar connecting the pair of side portions of the elongated member together and coupled to the board. The secondary crossbar extends along the board from the first side end in the pair of side ends to the second side end in the pair of side ends of the board.

BRIEF DESCRIPTION OF THE FIGURES

The detailed description of some embodiments of the invention will be made below with reference to the accompanying figures, wherein the figures disclose one or more embodiments of the present invention.

DETAILED DESCRIPTION OF CERTAIN EMBODIMENTS

In certain embodiments as depicted in FIGS. 1-4, the bumper apparatus generally comprises elongated member 10 and crossbars 12, which are coupled to a board vehicle such as a skateboard. Elongated member 10 serves as a barrier that protects the entire periphery of the skateboard from damage and wear including scratches, dents and the like.

Figure 4:
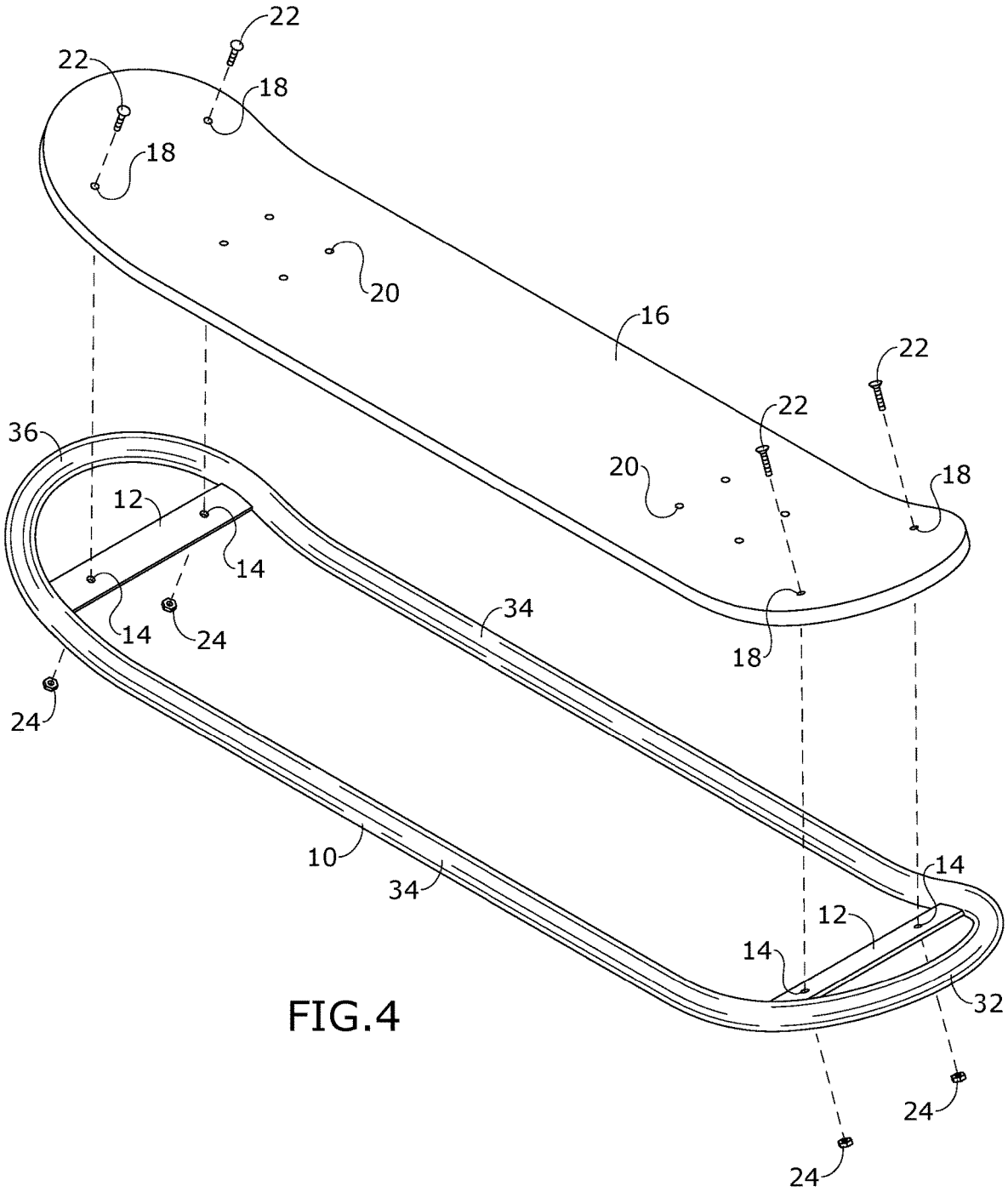
FIG. 4 depicts an exploded view of certain embodiments of the bumper apparatus.

In one embodiment, the skateboard comprises deck 16 coupled to a plurality of wheels 26 by trucks 17 as is known in the field. In one embodiment as depicted in FIG. 4, deck 16 comprises truck attachment holes 20, which are configured to receive mechanical fasteners such as screws to secure trucks 17 and wheels 26 to deck 16 of the skateboard. The components of the skateboard including deck 16, trucks 17 and wheel 26 can be made from any materials known in the field.

Figure 2:
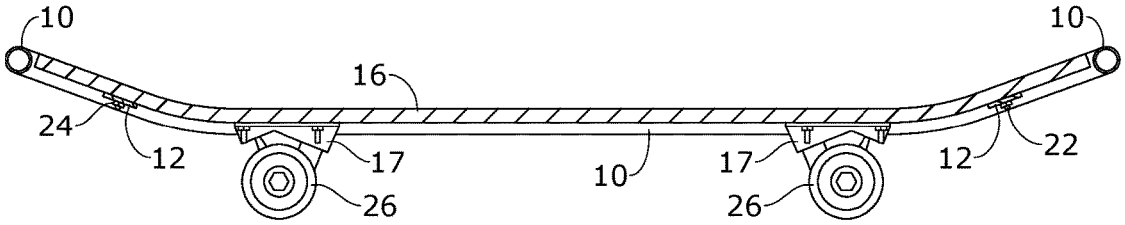
FIG. 2 depicts a section view of certain embodiments of the bumper apparatus taken along line 2-2 in FIG. 1.
Figure 3:
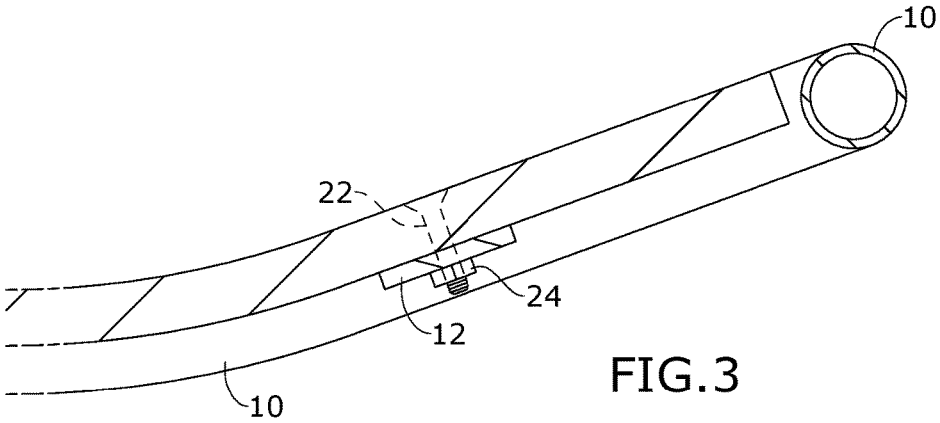
FIG. 3 depicts a section view of certain embodiments of the bumper apparatus.

In certain embodiments as depicted in FIGS. 2-4, elongated member 10 is preferably a bent tubular member that is a metal round pipe approximately 82" in length and ¾" in diameter. However, the dimensions of elongated member 10 can vary to accommodate different sized skateboards. In one embodiment, elongated member 10 is made from steel. However, other metals or materials can be used instead in alternative embodiments. In an alternative embodiment, elongated member 10 comprises a solid bent bar.

Figure 1:
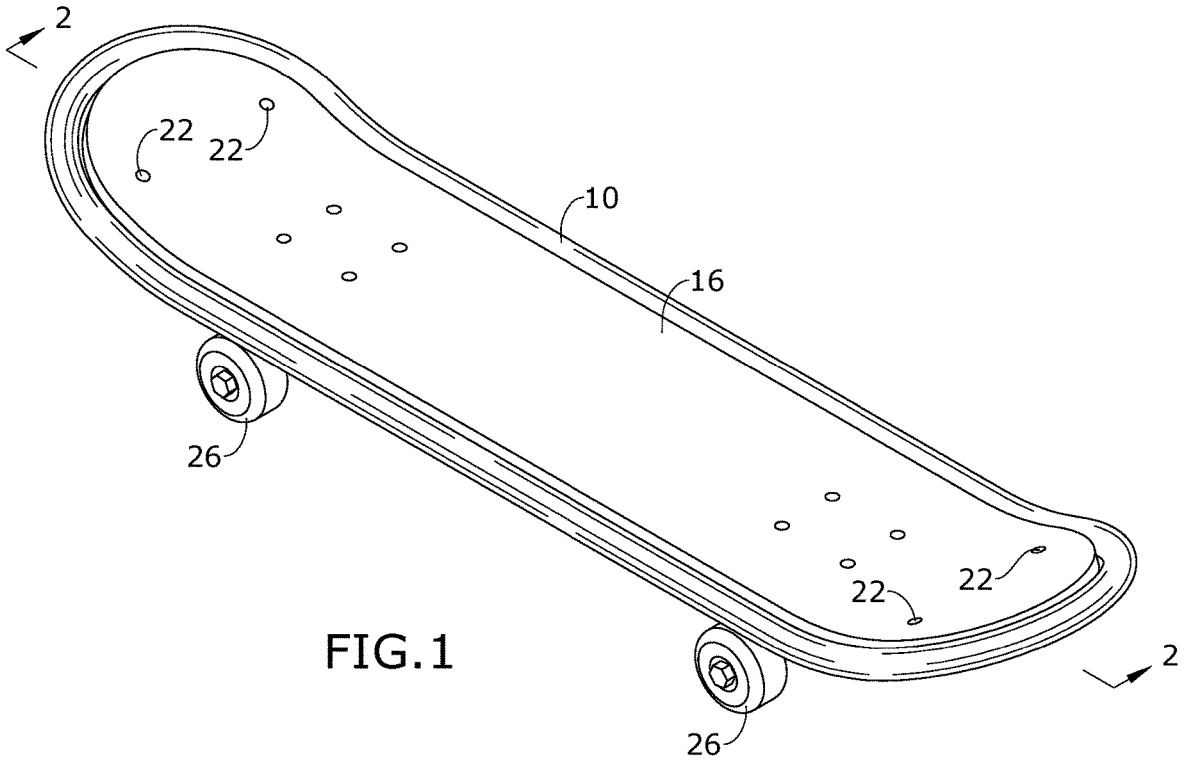
FIG. 1 depicts a perspective view of certain embodiments of the bumper apparatus.

In one embodiment as depicted in FIGS. 1-2, elongated member 10 is bent to form a generally oval shape that extends along the periphery of deck 16 of the skateboard. As depicted in FIG. 4, the bent elongated member 10 is formed by front portion 32 continuously connected to rear portion 36 by a pair of side portions 34. In one embodiment, the ends of elongated member 10 are welded together to form a closed oval-shaped member. In an alternative embodiment, the ends of elongated member can be coupled together using other fasteners.

In one embodiment, the front and end portions of deck 16 of the skateboard are bent upwards. In this embodiment, elongated member 10 comprises front and rear portions 32, 36 that extend upward approximately 15-20 degrees relative to the longitudinal axis of deck 16 of the skateboard. This allows elongated member 10 to follow the periphery of the skateboard. It shall be appreciated that the degree of bend in front and rear portions 32, 36 can vary depending on the shape of the skateboard.

In certain embodiments as depicted in FIG. 4, the bumper apparatus comprises a pair of crossbars 12 continuously connected to side portions 34 of elongated member 10. Each crossbar 12 comprises opposing ends welded to side portions 34 of elongated member 10. However, alternative fastening components can be used to couple crossbars 12 to elongated member 10.

In a preferred embodiment as depicted in FIG. 4, each crossbar 12 comprises a plate having approximate dimensions of 6½"×1"×⅛" with a pair of crossbar holes 14. Crossbars 12 are preferably made from steel. However, crossbars 12 can be made from alternative metals or materials. In one embodiment as depicted in FIGS. 3-4, a pair of bolts 22 is disposed through crossbar attachment holes 18 in deck 16 of the skateboard and crossbar holes 14 on crossbar 12. A pair of nuts 24 is coupled to the pair of bolts 22 to secure each crossbar 12 to deck 16 of the skateboard. In an alternative embodiment, any alternative number of mechanical fasteners such as bolts 22 and nuts 24 can be used to couple each crossbar 12 to the skateboard.

In one embodiment as depicted in FIG. 4, a first crossbar 12 is located proximate front portion 32 of elongated member 10 and a second crossbar 12 is located proximate rear portion 36 of elongated member 10. However, it shall be appreciated that first and second crossbars 12 can be located at variable locations on elongated bar 10. In one embodiment, crossbars 12 extend generally perpendicularly to the longitudinal axis of deck 16 of the skateboard. In alternative embodiments, it shall be appreciated that any alternative number of crossbars 12 can be used on elongated bar 10 to secure the bumper apparatus to deck 16 of the skateboard.

In operation, the bumper apparatus serves as a barrier that protects the entire periphery of deck 16 on the skateboard from damage and wear. In particular, the bent oval-shaped elongated member 10 and/or crossbars 12 contact the ground or other objects during use of the board. This minimizes or eliminates contact between portions of the skateboard and the ground and/or objects, thereby protecting the structural integrity of the skateboard. Crossbars 12 enhance the connection strength of the bumper apparatus to the skateboard, which allows elongated member 10 to remain in place, even after strong impacts with the ground or other objects.

Although the bumper apparatus is depicted for use with a skateboard, it shall be appreciated that the bumper apparatus can be used with other board vehicles including, but not limited to, snowboards, surfboards or other vehicles. As such, it shall be appreciated that the shape and dimensions of elongated member 10 and crossbars 12 may vary to accommodate the size and type of vehicle used. Regardless of the shape of the board vehicle, elongated member 10 should be configured to extend along the entire periphery of the vehicle.

It shall be appreciated that the components of the bumper apparatus described in several embodiments herein may comprise any alternative known materials in the field and be of any color, size and/or dimensions. It shall be appreciated that the components of the bumper apparatus described herein may be manufactured and assembled using any known techniques in the field.

Persons of ordinary skill in the art may appreciate that numerous design configurations may be possible to enjoy the functional benefits of the inventive systems. Thus, given the wide variety of configurations and arrangements of embodiments of the present invention, the scope of the invention is reflected by the breadth of the claims below rather than narrowed by the embodiments described above.

What is claimed is:

1. A bumper apparatus coupled to a board vehicle with enhanced connection strength and configured to protect portions along a periphery of the board vehicle from damage and wear during use, the board vehicle comprising a board with a top surface, a bottom surface joined to a front truck and a rear truck, a front end connecting the top and bottom surfaces together, a rear end connecting the top and bottom surfaces together, and a pair of side ends connecting the front and rear ends together, the bumper apparatus comprising:

a bent elongated member further comprising a round metal pipe, with a pathway extending along the periphery of the board vehicle along the front end, rear end and pair of side ends, the elongated member comprising a front portion continuously connected to a rear portion by a pair of side portions; and a primary crossbar connecting the pair of side portions of the elongated member together and coupled to the board forward of the front truck with a first pair of bolts, the primary crossbar extending along the board from the first side end in the pair of side ends to the second side end in the pair of side ends of the board;

a secondary crossbar connecting the pair of side portions of the elongated member together and coupled to the board reward of the rear truck with a second pair of bolts, the secondary crossbar extending along the board from the first side end in the pair of side ends to the second side end in the pair of side ends of the board wherein the bent elongated member is configured to serve as a barrier along the front, rear and side ends of the board vehicle during use.

2. The bumper apparatus of claim 1, wherein each crossbar in the primary and secondary crossbars comprises a plate.

3. The bumper apparatus of claim 2, wherein the primary crossbar extends generally perpendicular to a longitudinal axis of the board, wherein the secondary crossbar extends generally perpendicular to the longitudinal axis of the board.

4. The bumper apparatus of claim 3, wherein the primary crossbar is located proximate the front end of the board and the secondary crossbar is located proximate the second end of the board.

5. The bumper apparatus of claim 4, further comprising a first pair of mechanical fasteners coupling the primary crossbar and board together and a second pair of mechanical fasteners coupling the secondary crossbar and board together.

6. The bumper apparatus of claim 5, wherein each portion in the front and rear portions of the elongated member is bent upward.

* * * * *